US005379532A

United States Patent [19]

Seidel

[11] Patent Number: 5,379,532

[45] Date of Patent: Jan. 10, 1995

[54] SKI BOOT

[75] Inventor: Sigurd Seidel, Graz, Austria

[73] Assignee: Raichle Sportschuh AG, Kreuzlingen, Switzerland

[21] Appl. No.: 52,746

[22] Filed: Apr. 27, 1993

[30] Foreign Application Priority Data

Apr. 28, 1992 [CH] Switzerland ..... 01358/92

[51] Int. Cl.[6] ..... A43B 5/04

[52] U.S. Cl. ..... 36/119; 36/120

[58] Field of Search ..... 36/117, 118, 119, 120, 36/121

[56] References Cited

U.S. PATENT DOCUMENTS

| | | | |
|---|---|---|---|
| 4,447,968 | 5/1984 | Spademan | 36/119 X |
| 4,724,626 | 2/1988 | Baggio | 36/119 X |
| 4,910,892 | 3/1990 | Perissoud | 36/120 |
| 4,922,634 | 5/1990 | Seidel | 36/119 |
| 5,175,949 | 1/1993 | Seidel | 36/119 |

FOREIGN PATENT DOCUMENTS

| | | | |
|---|---|---|---|
| 0157118 | 10/1985 | European Pat. Off. | 36/119 |
| 0423584A1 | 4/1991 | European Pat. Off. . | |
| 0423585A1 | 4/1991 | European Pat. Off. . | |
| 2425207 | 12/1979 | France . | |
| 2564711 | 11/1985 | France . | |
| 2807348 | 8/1979 | Germany | 36/120 |

*Primary Examiner*—Paul T. Sewell
*Assistant Examiner*—BethAnne C. Cicconi
*Attorney, Agent, or Firm*—Oliff & Berridge

[57] ABSTRACT

A ski boot includes a pull element coupled to a tensioning device. The tensioning device has two levers located on a bearing shaft that interact with tensioning bodies that guide the pull element. Control elements that interact with the levers are connected to the leg support shaft of the ski boot and are displaceable in the longitudinal direction corresponding to the pivoting position of the shaft. A control path is designed on the levers in a first pivoting range, and the control elements interact with a first section of the control path. Upon pivoting the shaft toward the front in the first pivoting range, the levers pivot toward one another in a scissor-like manner and thus move the two tensioning bodies away from one another to tension the pull element. In a second pivoting range of the shaft, the control elements interact with a second section of the control path that extends to the movement path of the control element. In the second pivoting range, the tension of the pull element is maintained but not increased.

20 Claims, 3 Drawing Sheets

SKI BOOT

BACKGROUND OF THE INVENTION

1. Field of the Invention

The invention relates to a ski boot having a foot holding device. More particularly, the invention relates to a foot holding device with a selectively tensioned pull element.

2. Description of Related Art

A ski boot of this type is known from European Patent Application Publication Nos. EP-A-0423 584 and 0 423 585. In each of these boots, a front shaft part surrounding the lower tibia region of the leg, a rear shaft part surrounding the heel region of the foot and a lower fibula region are pivotally articulated on a shell part surrounding the foot. Each boot has a sole and a pair of axes, including a longitudinal axis running parallel to the sole and a transverse axis running at right angles to the longitudinal direction of the boot. The interior of the ski boot is delimited by the shell part and the shaft part. A foot-holding device is disposed in the interior of the boot. The foot holding device includes a cable-type pull element that reaches around a holding element covering the instep of a foot in a saddle-like manner, and a heel cap. The pull element is guided from the rear around a tensioning element of a tensioning device present in the sole region and displaceable in the longitudinal direction of the boot.

The movement of the tensioning element occurs through the joint pivoting of both the front and rear shaft parts. To this end, the front shaft part is connected in a rotationally fixed manner to an actuating lever arrangement, which is pivotable about the transverse axis and coupled to control elements which are displaceable in the longitudinal direction of the boot. The control elements have rack-shaped toothings that mesh with toothed wheels rotatably mounted on the sole and are in engagement with corresponding toothings on the tensioning element. If the shaft parts are pivoted back into a standing position, in which they run approximately at right angles to the sole, the tensioning element is consequently situated in its rear end position, corresponding to the skiing position, the tensioning element is displaced towards the front in the longitudinal direction of the boot. This displacement results in the tensioning of the pull element and, consequently, the pressing of the holding element and of the heel cap against the foot.

Provided between the shell part and the front shaft part is a catch device that detachably holds the shaft parts in the desired forward lean position. The catch device can adjust the forward lean position. The shaft parts can also pivot in the direction toward the front, beyond the set forward lean position. Consequently, the more the shaft parts are pivoted toward the front and out of the standing position, the greater the pull element is tensioned. This tensioning can lead to an unpleasant pressure on the foot of the skier by the foot holding device, especially when the forward lean position is greatly inclined towards the front.

SUMMARY OF THE INVENTION

An object of the present invention is to provide a ski boot that safeguards the skier, irrespective of the forward lean position assumed for skiing, by ensuring good support in the ski boot.

This and other objects are achieved by a ski boot according to this invention that includes a shaft part forming the boot structure coupled to a tensioning element disposed within the boot. The tensioning element is coupled to the pull element of a foot holding device for selectively holding a skier's foot in place. The coupling between the shaft part and the tensioning element acting on the pull element is designed so that the pull element is tensioned or released according to the pivoting position of the shaft part when the shaft part moves within a given pivoting range. If, however, the shaft part is pivoted beyond this pivoting range, no further tensioning of the pull element takes place, but the tensioning is maintained.

In a ski boot according to this invention, the pull element is released when the shaft part is in the standing position. Upon pivoting of the shaft part into the desired forward lean position, the pull element is tensioned in a first pivoting range of the shaft part and, upon pivoting beyond this pivoting range, no further tensioning of the pull element occurs.

BRIEF DESCRIPTION OF THE DRAWINGS

The invention is described in greater detail with the aid of the exemplary embodiment represented in the drawings.

DETAILED DESCRIPTION OF PREFERRED EMBODIMENTS

Figure 1:
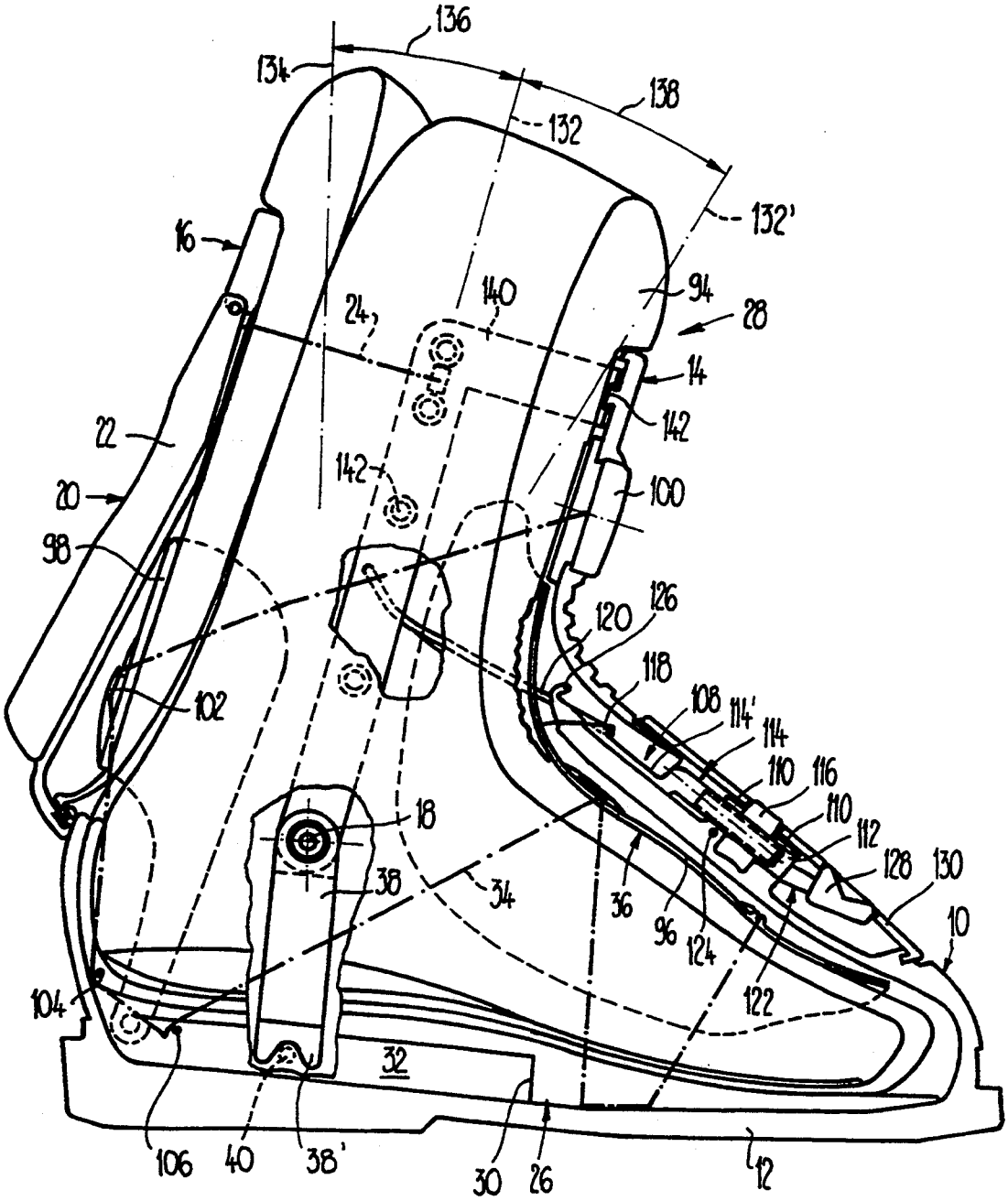
FIG. 1 is a schematic side elevation in section of the ski boot according to the invention.

The ski boot according to this invention has a shell part 10 that is intended to surround the foot of the skier. A sole 12 is molded on the shell part 10. A transverse axis 18 runs essentially parallel to the sole 12 and approximately at right angles to the longitudinal direction of the boot. Pivotally articulated on the shell part 10 about the transverse axis 18 in the region of the ankle is a shaft 28 formed by a front shaft part 14 intended to surround the lower tibia and a rear shaft part 16 intended to surround the upper heel region and lower fibula region.

To open the ski boot, the rear shaft part 16 is pivoted toward the rear about the axis 18. To close the ski boot, the front shaft part 14 and rear shaft part 16 are tensioned in relation to one another by means of a closure 20. In the exemplary embodiment, the closure 20 has a pivoting lever 22 that is arranged on the rear shaft part 16 and is operationally connected to a closure cable 24 fastened on both sides on the front shaft part 14. If the pivoting lever 22 is situated in the position shown in FIG. 1, bearing against the rear shaft part 16, the closure cable 24 is tensioned, and the ski boot is closed. By pivoting the pivoting lever 22 in the counter-clockwise direction, the closure cable 24 is released so that the ski boot can be opened by folding the rear shaft part 16 toward the rear. The closure 20 can, of course, also be designed differently. For example, the closure 20 may be designed as a rotary closure.

Figure 2:
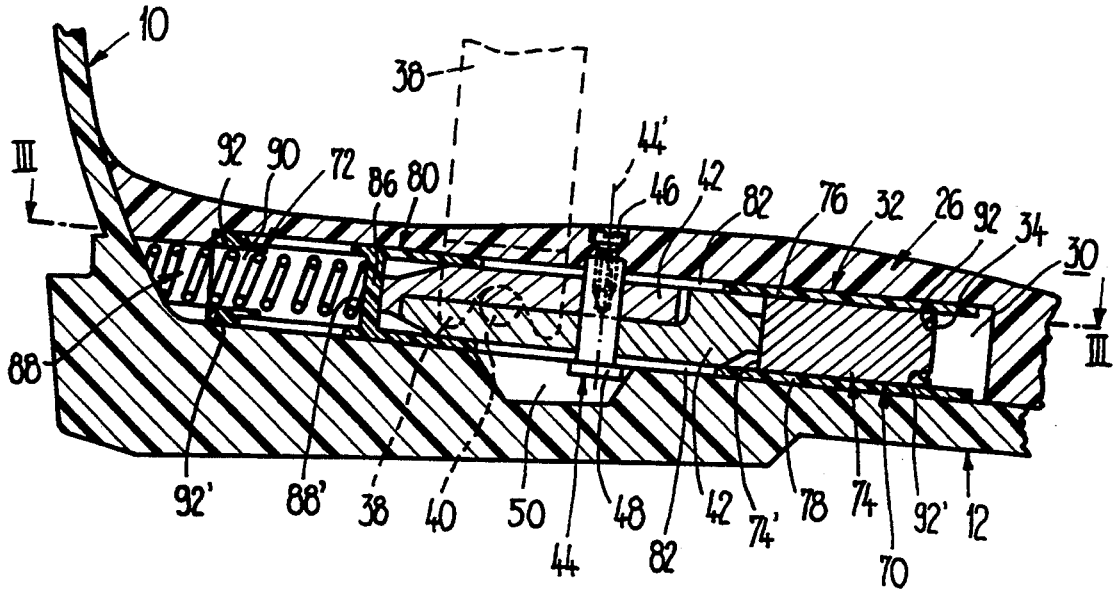
FIG. 2 is an enlarged partial sectional view of the ski boot according to FIG. 1 showing the tensioning device in the sole region of the ski boot.

An insole 26 is inserted into the shell part 10 and fixed in relation to the sole 12 in a generally known manner. In the region below the shaft 28, the insole 26 has a cutout 30 which is open toward the sole 12. A tensioning device 32 is arranged in the cutout 30 as seen in FIG. 2. The tensioning device 32 tensions a cable-type pull element 34 of a foot-holding device 36 arranged in the interior of the ski boot. As shown in FIG. 1 in dot/-dash lines, the foot holding device 36 is disposed in the inner space delimited by the shell part 10 and the shaft 28.

Figure 3:
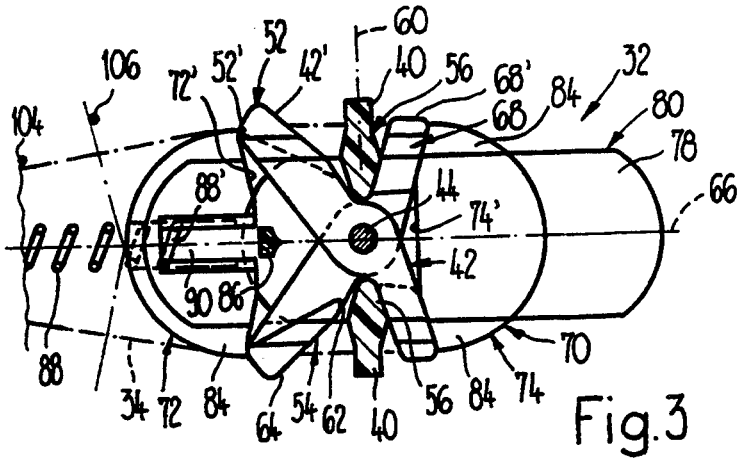
FIG. 3 is a partial top view of the tensioning device in partial section taken along line III—III in FIG. 2 and the shaft part is in the standing position.
Figure 4:
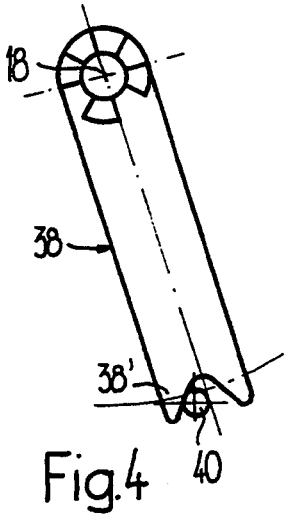
FIG. 4 shows the position of the actuating levers when the shaft part is situated in the standing position as in FIG. 3.
Figure 5:
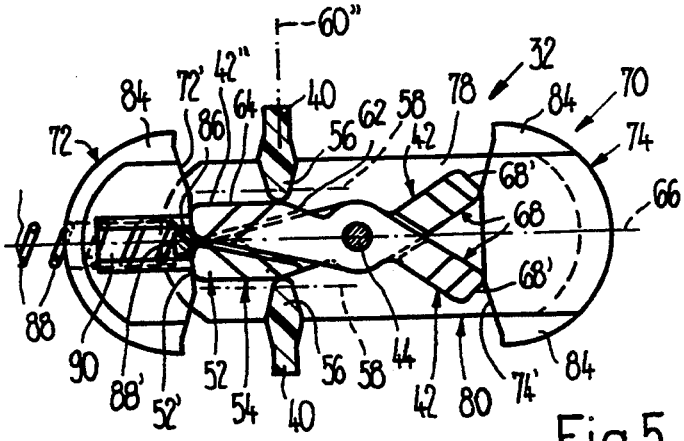
FIG. 5 is a partial top view of the tensioning device in partial section when the shaft part is in the minimum forward lean position.
Figure 7:
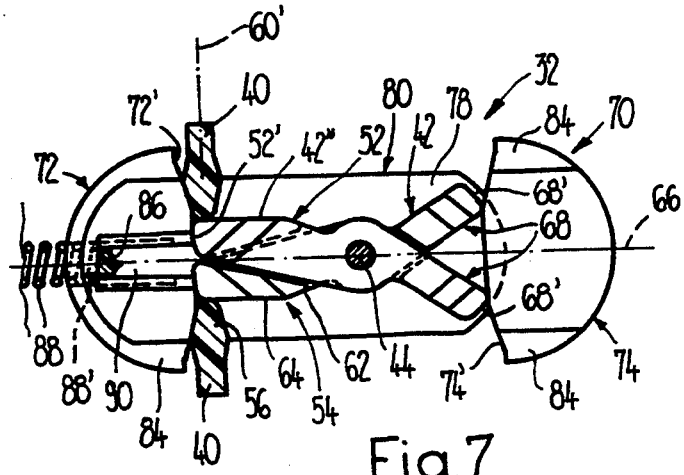
FIG. 7 is a partial top view of the tensioning device in partial section when the shaft part is in the maximum forward lean position.
Figure 8:
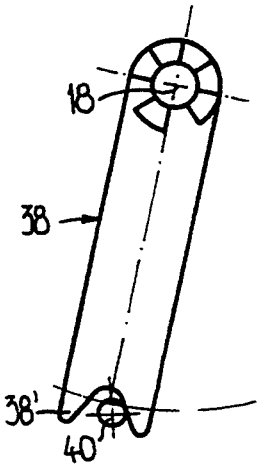
FIG. 8 shows the actuating levers when the shaft part is situated in the maximum forward lean position as in FIG. 7.

The foot-holding device 36 is actuated by pivoting the front shaft part 14. To enable pivoting, actuating levers 38 are provided in the interior of the ski boot on each side. The actuating levers 38 are pivotable about the axis 18 and are rotationally fixed to the front shaft part 14, as known. The actuating levers 38 penetrate slots (not shown in the figures) in the insole 26. The slots extend in the longitudinal direction of the boot and connect the interior of the ski boot to the cutout 30. The end region 38' of each of the actuating levers 38 adjacent the slots has a fork-like design. As shown in FIGS. 4, 5 and 8, the end region 38' reaches around driver pins 40 of the tensioning device 32. As seen in FIGS. 3, 5 and 7, a pair of driver pins 40 extend at right angles to the longitudinal direction of the boot.

FIGS. 2–8 show the tensioning device 32 in detail. Two levers 42 act as a transmission member 41 and sit freely rotatable on a bearing shaft 44. The axis 44' of the bearing shaft 44 extends approximately in the central longitudinal plane of the ski boot and transversely to the sole 12. The bearing shaft 44 is fastened to the insole 26 by a screw 46 and passes through the cutout 30 into a sole cutout 50. Bearing shaft 44 has a free head-like end 48 that engages with the sole cutout 50 as seen in FIG. 2.

The levers 42 are designed with diametrically opposed double-arms. As shown in FIG. 3, the levers 42 are pivoted from a rest position 42' into a working position 42", shown in FIGS. 5 and 7. An outer side surface 52 of the rear lever arm, extending in the longitudinal direction of the boot, acts as a control path 54. The driver pins 40 taper toward rounded ends and form control elements 56 that interact with the outer side surface 52 of each rear lever arm of the levers 42 along the control path 54. The control elements 56 are displaced along a movement path 58 that extends approximately in the longitudinal direction of the boot as indicated in FIG. 5. The control elements 56 travel to and from a front end position 60, shown in FIG. 3, located at the bearing shaft 44, into a rear end position 60', shown in FIG. 7.

The control path 54 has two adjoining sections 62 and 64. The first section 62 is situated closer to the bearing shaft 44 than the second section 64. The first section 62 is disposed at a greater angle with the central longitudinal plane of the boot 66, than the angle at which the second section 64 is disposed. When the levers 42 are in the working position 42", the second section 64 extends parallel to the movement path 58 of the control elements 56 and consequently parallel to the central longitudinal plane 66 of the boot.

If the control elements 56 are in the front end position 60 (FIG. 3), the scissor-like levers 42 are splayed, and the first section 62 forming the control path 54 intersects the movement path 58 of the relevant control element 56. The splaying movement is limited by the front lever arms 68 bearing against the corresponding control elements 56 on the tapered side facing the front side of the ski boot. In FIG. 4, the pivoting position of the actuating levers 38 is shown when the control elements 56 are in the front end position 60.

When the actuating levers 38 are pivoted into a pivoting position that extends approximately at right angles to the sole 12 (FIG. 6), the control elements 56 move along their movement path 58 into an intermediate position 60", seen in FIG. 5. In this case, the control elements 56 interact with the first section 62 causing the levers 42 to pivot toward one another in a scissor-like manner into the working position 42". If the actuating levers 38 are pivoted further in the clockwise direction, out of the position shown in FIG. 6, the control elements 56 interact with the second sections 64 defining the control paths 54 and prevent the levers 42 from pivoting farther. Thus, the levers 42 are held in their working position 42', which includes any position of the control elements 56 between the intermediate position 60" and the rear end position 60'.

Figure 6:
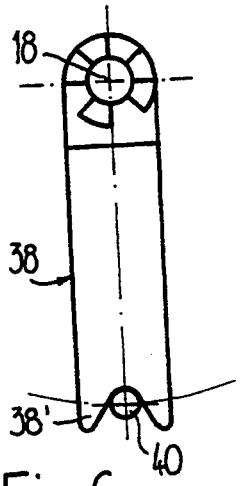
FIG. 6 shows the actuating levers when the shaft part is situated in the minimum forward lean position as in FIG. 5.

The tensioning device 32 also has a tensioning element 70 with a first tensioning body 72 and a second tensioning body 74. The first tensioning body 72 and the second tensioning body 74 can be moved toward and away from one another in the longitudinal direction of the boot. The levers 42 are arranged between the tensioning bodies 72, 74. The free ends 52' of the rear lever arms 52 interact with the front side 72' of the first tensioning body 72, which faces them, and the free ends 68' of the front lever arms 68 interact with the rear side 74' of the second tensioning body 74, which faces them. When the levers 42 are in the rest position 42', the tensioning bodies 72, 74 are consequently arranged close to one another. When the levers 42 are pivoted into their working position 42" (FIGS. 5, 7), the tensioning bodies 72, 74 are pushed away from one another, and the corresponding ends 52', 68' of the levers 42 slide toward one another along the front side 72' or rear side 74' of the first or second tensioning body 72, 74, respectively. As seen from FIGS. 3–7, the tensioning bodies 72, 74 are only moved away from one another when the control elements 56 are displaced from the front end position 60 (FIG. 3) into the intermediate position 60" (FIG. 6). On farther movement of the control elements 56 into their rear end position 60', the tensioning bodies 72, 74 maintain their position (FIG. 7). The levers 42 can of course splay again, and the tensioning bodies 72, 74 can move toward one another, when the control elements 56 are moved from the intermediate position 60" into the front end position 60.

As seen from FIG. 3, the pull element 34, which is indicated with a dot/dash line, is guided around the first and second tensioning body 72, 74. Separating the tensioning bodies 72, 74 consequently tensions the pull element 34. Moving tensioning bodies 72, 74 together releases the pull element 34.

Referring to FIG. 2, the two control elements 56 interconnect an upper wall part 76 and a lower wall part 78 of a slide-like guide element 80. The upper and lower wall part 76, 78 have slot-like openings 82 that extend in the longitudinal direction of the boot and are engaged by the bearing shaft 44. Thus, the guide element 80 is guided displaceably on the bearing shaft 44 in the longitudinal direction of the boot. The tensioning bodies 72, 74 are arranged between the upper and lower wall parts 76, 78 and project laterally beyond the upper and lower wall parts 76 and 78. As seen in FIGS. 3, 5 and 7, the tensioning bodies 72 and 74 have guide noses 84, which reach around the wall parts 76, 78 laterally, to guide the tensioning bodies 72, 74 on the guide element 80 in a sliding manner in the longitudinal direction of the boot.

Centrally in their rear end region, the upper wall part 76 and lower wall part 78 are interconnected via web 86. The web 86 is provided to interact with a spring element 88, which in the present case is designed as a helical spring but may be formed as any suitable biasing element. The first tensioning body 72 has an opening 90 that extends in the longitudinal direction of the boot. The spring element 88, which is supported at the rear end on the sole 12, is movably engaged in the opening 90. The spring element 88 is designed so that the web 86 only abuts the front end 88' of the spring 88 when the control elements 56 are in the intermediate position 60" (FIG. 5) after moving from the front end position 60. Consequently, the closer the control elements 56 are to their rear end position 60', the greater is the force of the spring element 88 acting toward the front, seen in the longitudinal direction of the boot.

The side of the web 86 facing the levers 42 is designed to be engaged between the levers in a wedge-shaped manner. As best seen in FIG. 3, the web 86 has a pointed shape directed toward the control elements 56. The web 86 is positioned in relation to the control elements 56 so that the levers 42 pivot away from one another when the control elements 56 pass from the second section 64 to the first section 62 of the control path 54.

For guiding the pull element 34, the first and second tensioning bodies 72, 74 have upper and lower guide grooves 92, 92' (see FIG. 2).

Provided in a generally known manner in the interior of the ski boot is a cushioned inner boot 94 (FIG. 1). The foot-holding device 36 has a holding element 96 that is arranged between the inner boot 94 and the shell part 10 and reaches around the foot from above in a saddle-shaped manner. Moreover, a heel-holding element 98 is pivotally articulated on the insole 26. The heel-holding element 98 reaches around the foot from behind, in a saddle-like manner, in the region of the Achilles' tendon and is provided between the rear shaft part 16 and part of the inner boot 94.

The holding element 96 is pulled in the direction of the sole and toward the rear by the pull element 34. At the same time, the heel-holding element 98 is pulled in the direction toward the front by the pull element 34.

The cable-type pull element 34 is designed as an endless loop, the length of the loop being adjustable by an adjusting element 100 fastened centrally on the front shaft part 14. From the adjusting element 100, the pull element 34 extends between the front shaft part 14 and the inner boot 94 to the heel-holding element 98, around the latter to a generally known deflection member 104, which is arranged in the heel region on the shell part 10. As seen in particular from FIG. 3, the pull element 34 reaches around the deflection member 104 in the upper guide grooves 92 of the first and second tensioning bodies 72 and 74. Then, the pull element 34 is guided around the second deflection members 106, indicated schematically in FIGS. 1 and 3, and extends to the holding element 96. The pull element 34 is guided around the holding element 96, in the rear instep region, onto the other side of the ski boot and extends to the sole 12. At the sole 12, the pull element 34 is deflected, in a known manner, and once again winds around the holding element 96 in the front instep region. The pull element 34 then extends back to the adjusting element 100 in a diametrically opposed manner, engaging the lower guide grooves 92' in the first tensioning body 72 and second tensioning body 74, respectively.

In the instep region, a catch device 108 acts between the shell part 10 and the front shaft part 14. Formed on the shell part 10 are two bearing noses 110, which project toward the top and, seen in the longitudinal direction of the boot, are arranged one behind the other. An opening 112 lies approximately in the central longitudinal plane of the boot and runs parallel to the shell part 10. An adjusting screw 114 passes through the opening 112 and interacts with an adjusting nut 116 that is provided between the bearing noses 110 and is undisplaceably held by the bearing noses 110 in the longitudinal direction of the boot. Formed on the screw shaft 114' at the rear end is a catch nose 118 that interacts with a bow-like catch element 120 fastened on the front shaft part 14. In a region adjoining the catch nose 118, the adjusting screw 114 is flattened and bears against the shell part 110 for protection against rotation. By turning the adjusting screw 114, the position of the catch nose 118 can be adjusted in the longitudinal direction of the boot. Pivotally mounted on the rear bearing nose 110 on a shaft 124 running parallel to the sole 12 and at right angles to the longitudinal direction of the boot, is a double-armed release lever 122. The release lever 122 extends below the catch element 120 and has a hook 126 at its rear end that is directed toward the top of the boot. Arranged at the front end on the release lever 122 is an actuating head 128 that has an indentation on the upper side for receiving the ski-pole tip, in order to pivot the release lever 122 in the clockwise direction. The release lever 122 is pretensioned in the counterclockwise direction in a known manner and is held in the position represented in FIG. 1 by bearing against the shell part 10. The catch device 108 is covered by a cover element 130 which has openings for the adjusting nut 116 and the actuating head 128.

In the position of the catch nose 118 shown FIG. 1, the shaft 28 is held in a forward lean position corresponding to a minimum forward lean position 132 indicated by the dot/dash longitudinal axis of the shaft 28. By pressing the actuating head 128 downward, the release lever 122 is pivoted in the clockwise direction, which has the effect of displacing the catch element 120 toward the top, out of the effective range of the catch nose 118. The shaft 28 can consequently be pivoted back into a standing position 134, which is likewise indicated in a dot/dash manner, and in which the shaft 28 runs approximately at right angles to the sole 12. The backward movement of the shaft 28 into standing position 134 is limited by the action of the hook 126 on the catch element 120. The shaft 28 can consequently be freely pivoted back and forth in a first pivoting range 135 between the standing position 134 and the minimum forward lean position 132, without in this case catching on the catch nose 118. This allows a user to stand up straight and walk problem-free while wearing the ski boot. The minimum forward lean position 132 is inclined toward the front by between approximately 10° and 20°, preferably between 15° and 18°, in relation to a normal to the sole.

If the shaft 28 is pivoted in the direction toward the front, beyond the first pivoting range 136, the catch element 120 automatically reaches behind the catch nose 118 as it is resiliently pretensioned in the clockwise direction. The shaft 28 is then held in the minimum forward lean position 132 but can be pivoted farther toward the front out of this position.

A second pivoting range 138 adjoins the first pivoting range 136 in the direction toward the front. By turning the adjusting nut 116, the catch nose 118 can assume any position to hold the shaft 28 in the desired forward lean position in the second pivoting range 130 for skiing downhill. The maximum forward lean position 132' is inclined toward the front by between about 25° and 35°, preferably between 30° and 40°, in relation to the normal to the sole. In any position of the catch nose 118, the catching between the shell part 10 and the front shaft part 14 can be released. The shaft 28 can then be pivoted freely between this forward lean position 132 and the standing position 134.

The front shaft part 14 is reinforced with an angled, band-like reinforcement element 140, for example made of steel. This reinforcement element 140 is fastened on the front shaft part 14 via holding studs 142 that pass through the reinforcement element 140. For good stability, the closure cable 24 acts on the reinforcement element 140, and the actuating levers 38 are rotatably connected to the reinforcement element 140. The catch element 120, which, for example, can be made from spring steel wire, also acts on the reinforcement element 140 and is held thereon in a twist-proof manner to ensure the automatic catching with the catch nose 118.

If the front shaft part 14 is in the position corresponding to the standing position 134, the tensioning device 132 assumes the position shown in FIGS. 3 and 4. In this case, the pull element 34 is untensioned and the foot-holding device 36 is released. This allows comfortable standing with the ski boot closed or easy dressing and removal of the opened ski boot.

The position of the tensioning device 32 shown in FIGS. 5 and 6, in which the pull element 34 is fully tensioned, corresponds to the minimum forward lean position 132 of the shaft 28. This means that when the shaft 28 is pivoted toward the front out of the standing position 134 into the minimum forward lean position 132 in the first pivoting range 136, the pull element 34 is successively tensioned. The farther the shaft 28 is inclined toward the front within the first pivoting range 136, the greater the pull element 34 is tensioned and the greater the action of the foot-holding device 36. This makes extremely comfortable walking possible.

If the shaft 28 is pivoted into the second pivoting range 138, no further tensioning of the pull element 34 takes place, but it is held with the tension achieved in the minimum forward lean position 132. This is because during pivoting in the second pivoting range 138, the control elements 56 interact with the second section 64 of the levers 42 held in the working position 42'' (FIGS. 7 and 8). In each skiing position of the shaft 28 within the second pivoting range 138, the holding force of the foot-holding device 36 acting on the foot is therefore constant, which leads to extremely comfortable skiing. Adjustment of the active length of the pull element 34 by the adjusting element 100 dependant upon the desired skiing position is no longer necessary. It is consequently only necessary to adjust, with the adjusting element 100, the desired length of the pull element 34 a single time when the shaft 28 is in the second pivoting range 138.

The spring element 88 acts on the front shaft part 14 when the latter is in the second pivoting range 138. During skiing, blows are damped by the spring element 88, but the shaft 28 is freely movable for walking.

It is of course also conceivable to couple the tensioning device to the rear shaft part. Thus, a pull element could, for example, be tensioned during closing of the ski boot.

It is also conceivable to connect one lever of the tensioning device to a winding-up drum to wind up the pull element 34 thereon. In this case, the tensioning bodies can be omitted.

It would also be possible to provide only a single lever or to design the levers with only one arm, in which case only a single tensioning body would then have to be provided.

While advantageous embodiments have been chosen to illustrate the invention, it will be understood by those skilled in the art that various changes and modifications can be made without departing from the scope of the invention as defined in the appended claims.

What is claimed is:

1. A ski boot having a longitudinal axis and a transverse axis, comprising:

a shell configured to surround a skier's foot, said shell including a sole extending substantially parallel to said longitudinal axis;

a shaft configured to surround a skier's leg pivotally coupled to said shell about a pivot axis substantially parallel to said transverse axis;

a foot-holding device disposed within said shell and said shaft including a cable-pull element and an actuating mechanism; and a tensioning device disposed in said shell and coupled to said foot-holding device, including a movable control mechanism coupled to said actuating mechanism, a tensioning mechanism coupled to said cable-pull element, and a rotatable transmission member disposed between said control mechanism and said tensioning mechanism, said transmission member transmitting movement from said control mechanism to said tensioning mechanism, wherein said transmission member has a surface defining a control path including a first section and a second section extending from said first section at an angle thereto, and wherein said control mechanism abuts said surface and travels along said first section imparting movement to said transmission member thereby increasing tensioning said cable-pull element, and travels along said second section imparting no movement to said transmission member thereby maintaining an essentially constant tension in said cable-pull element.

2. The ski boot of claim 1, wherein said shaft is pivotal in a first pivoting range from a standing position substantially perpendicular to said sole to a forward lean position, and is pivotal in a second pivoting range from the forward lean position to a position more angled toward said sole, and said actuating mechanism is pivotally coupled to said shaft and imparts pivoting of said shaft to said transmission member.

3. The ski boot of claim 2, further comprising a detachable catch coupled between said shell and said shaft, said catch detachably holding said shaft in said forward lean position.

4. The ski boot of claim 3, wherein said catch is adjustable and adjusts said forward lean position within said second pivoting range.

5. The ski boot of claim 3, wherein said catch includes a hook hooking said shaft in said standing position when said catch is released and said shaft pivots from said forward lean position to said standing position.

6. The ski boot of claim 1, wherein said transmission member is rotatable between a rest position and a working position, and said first section is disposed at an angle to said longitudinal axis in said rest position and said working position, and said second section is disposed at an angle to said longitudinal axis in said rest position and is substantially parallel to said longitudinal axis in said working position.

7. The ski boot of claim 1, wherein said transmission member is a rotatably mounted lever with free ends and said surface is a side face of said lever, wherein said free ends abut said tensioning mechanism.

8. The ski boot of claim 7, wherein said tensioning mechanism comprises a pair of relatively movable spaced tensioning bodies, and said cable-pull element engages said tensioning bodies and said lever is disposed between said tensioning bodies with each of said free ends abutting one of said tensioning bodies.

9. The ski boot of claim 1, wherein said tensioning mechanism comprises a pair of relatively movable spaced tensioning bodies, and said cable-pull element engages said tensioning bodies and said transmission member is disposed between said tensioning bodies.

10. The ski boot of claim 1, wherein said transmission member comprises a pair of rotatable levers coaxially mounted in a scissors type arrangement.

11. The ski boot of claim 10, wherein said control mechanism comprises a pair of opposed control members, and wherein said surface of said control path comprises a side face of each of said levers, said control members each acting on said side face of each of said levers.

12. The ski boot of claim 1, wherein said tensioning device further comprises a guide element displaceable along said longitudinal axis and coupled to said control mechanism.

13. The ski boot of claim 12, wherein said tensioning device further comprises a spring disposed adjacent said guide element and biased by pivoting of said shaft.

14. The ski boot of claim 12, wherein said guide element abuts said spring when said shaft is pivoted forward into a ski position.

15. The ski boot of claim 12, wherein said tensioning mechanism is longitudinally movably mounted on said guide element.

16. The ski boot of claim 1, wherein said actuating mechanism is a lever having a first end pivotally coupled to said shaft and a second end with a forked configuration pivotally coupled to said control mechanism.

17. The ski boot of claim 1, wherein said shaft comprises a front part and a rear part relatively movable, and further comprising a closure coupled to said front part and said rear part securing said front part to said rear part for mutual pivoting with respect to said shell.

18. The ski boot of claim 1, further comprising a reinforcing member coupled to said shaft, wherein said actuating mechanism is pivotally coupled to said reinforcing member.

19. A ski boot having a longitudinal axis and a transverse axis, comprising:

a shell configured to surround a skier's foot, said shell including a sole extending substantially parallel to said longitudinal axis;

a shaft configured to surround a skier's leg pivotally coupled to said shell about a pivot axis substantially parallel to said transverse axis, said shaft being pivotal from a standing position to a forward lean position in a first range and being pivotal from the forward lean position to a more forward position in a second range;

a foot-holding device disposed within said shell and said shaft including a cable-pull element configured to tension around a skier's foot and lower leg, and an actuating mechanism coupled to said shaft; and a tensioning device disposed in said shell and coupled to said foot-holding device, including a movable control mechanism coupled to said actuating mechanism, an expandable tensioning mechanism coupled to said cable-pull element, and a rotatable linkage-type transmission member disposed between said control mechanism and said tensioning mechanism, said transmission member transmitting movement of said shaft to said cable-pull element, wherein said transmission member has a surface defining a control path including a first section and a second section extending from said first section at an angle thereto, and wherein said control mechanism abuts said surface, and wherein upon pivoting of said shaft through said first pivoting range, said control mechanism travels along said first section imparting movement to said transmission member and expanding said tensioning mechanism thus tensioning said cable-pull element, and upon pivoting of said shaft through said second pivoting range, said control mechanism travels along said second section imparting no movement to said transmission member and maintaining said tensioning mechanism in an expanded condition thus maintaining a tension in said cable-pull element.

20. The ski boot of claim 19 wherein said transmission member comprises at least one lever rotatable about an axis perpendicular to said sole, having a side face that forms said surface of said control path and opposed free ends that abut and interact with said tensioning mechanism to expand said tensioning mechanism.

* * * * *